US006581888B1

(12) United States Patent
Castillo

(10) Patent No.: US 6,581,888 B1
(45) Date of Patent: Jun. 24, 2003

(54) IRREGULAR-SURFACE GLASS HOLDER

(76) Inventor: Kenneth Antonio Castillo, 224 Birch Ridge Cir., San Jose, CA (US) 95123

( * ) Notice: Subject to any disclaimer, the term of this patent is extended or adjusted under 35 U.S.C. 154(b) by 0 days.

(21) Appl. No.: 09/686,596

(22) Filed: Oct. 10, 2000

(51) Int. Cl.[7] ..... A47G 23/02
(52) U.S. Cl. ..... 248/146; 248/310; 248/346.2; 248/910
(58) Field of Search ..... 248/146, 346.2, 248/310, 910; 220/903, 737

(56) References Cited

U.S. PATENT DOCUMENTS 1,778,545 A * 10/1930 Allen
3,312,436 A * 4/1967 Beghetto, Jr.
4,130,263 A * 12/1978 Roericht
4,606,524 A * 8/1986 Conee ..... 248/346
4,788,916 A * 12/1988 Saxton
4,889,302 A * 12/1989 Tucker
4,964,600 A * 10/1990 Lee
5,909,811 A * 6/1999 Harris

* cited by examiner

*Primary Examiner*—Korie Chan
(74) *Attorney, Agent, or Firm*—Risto A. Rinne, Jr

(57) ABSTRACT

An apparatus for the stabilization of a drinking vessel such as a glass, coffee mug, or a piece of stemware that is placed on a flat or irregular or sloping surface includes a base portion having a flexible outer covering that surrounds a flexible weighted mass. An elastomeric member that includes an opening is attached to the base portion. The elastomeric member is urged into an open position which requires expanding the opening a sufficient amount to permit the bottom portion of the drinking vessel to pass through the opening and rest on top of the base portion. The elastomeric member is then allowed to retract into a closed position in which elastomeric tension secures the bottom portion of the drinking vessel to the top of the base portion. The apparatus is then placed on the desired surface where the drinking vessel is supported and thereby prevented from tilting or tipping. If the surface is irregularly shaped, the bottom surface of the base portion flexes and adapts to the irregular shape thereby permitting use of the apparatus on irregular surfaces. A modified elastomeric member, according to a modification, is not attached to a modified base portion but surrounds it concentrically and secures the vessel thereto as the vessel passes through an opening that is provided in the modified elastomeric member.

17 Claims, 1 Drawing Sheet

IRREGULAR-SURFACE GLASS HOLDER

BACKGROUND OF THE INVENTION

1. Field of the Invention

The present invention, in general, relates to cup holders and, more particularly, to devices that secure a drinking vessel upright on an irregular surface.

There has been a long standing need to secure a glass upon an irregular surface. For example, a sandy beach or a rock by the beach or a log by a campfire are places where it is desirable to place a glass containing a beverage.

In particular, connoisseurs of the "good life" often desire to enjoy a glass of wine at these special areas, yet are deterred because the irregular surfaces encountered are not suited to support a top-heavy piece of stemware.

In addition, known types of cup holders fail to adequately anticipate the height of the stem portion of a piece of stemware.

In particular, the current state of the art to secure a glass or a cup includes a receptacle for placement of a cup therein and an upper circular stabilizing portion that makes contact with the cup at a higher elevation to prevent side to side tipping of the cup from occurring.

This type of a design has limited utility. It is sized to work with a particular size and shape of glass. Also, this approach fails to work with stemware because the upper circular support likely aligns with the stem portion instead of aligning with the actual elevated container portion.

If the upper support aligns with the stem portion, it is disposed away from it and, therefore, fails to provide support or protection from tipping.

In general, the known prior art requires that the size and shape of the glass be known ahead of time and it is not adapable for use with stemware or oddly shaped glasses.

Accordingly there exists today a need for an irregular-surface glass holder that is suitable for use with cups and glass containers in general, and which is also suitable for use with stemware.

Clearly, such an apparatus would be a useful and desirable device.

2. Description of Prior Art

Cup holders and other irregular surface adapting devices are, in general, known. For example, the following patents describe various types of these devices:

U.S. Pat. No. 2,219,974 to Bellow, Oct. 29 1940;

U.S. Pat. No. 2,806,131 to Palmer, Sep. 10, 1957;

U.S. Pat. No. 3,312,436 to Beghetto, Jr., Apr. 4, 1967;

U.S. Pat. No. 4,130,263 to Roericht, Dec. 19, 1978;

U.S. Pat. No. 4,162,696 to Sprung, Jul. 31, 1979;

U.S. Pat. No. 4,510,401 to Conee, Feb. 26, 1985;

U.S. Pat. No. 5,350,147 to Paganus, Sep. 27, 1994;

U.S. Pat. No. 5,810,313 to Armstrong, Sep. 22, 1998; and

U.S. Pat. No. 6,073,902 to Hiles, Jun. 13, 2000.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an irregular-surface glass holder that can support a glass on an irregular surface.

It is also an important object of the invention to provide an irregular-surface glass holder that can support stemware on an irregular surface.

Another object of the invention is to provide an irregular-surface glass holder that secures the base of a glass to a mass.

Still another object of the invention is to provide an irregular-surface glass holder that includes an elastomeric member that is attached to a mass and is able to secure a drinking type of a vessel thereto.

Still yet another object of the invention is to provide an irregular-surface glass holder that can support a variety of different types of vessels, including cups and mugs.

Yet another important object of the invention is to provide an irregular-surface glass holder that includes an elastomeric member that surrounds a mass and is able to secure a drinking type of a vessel to the mass.

Still yet another important object of the invention is to provide an irregular-surface glass holder that includes a mass that contains either a granular material or a liquid.

One further object of the invention is to provide an irregular-surface glass holder that includes a base that contains a plurality of compartments, each compartment containing a portion of the total mass.

Briefly, an irregular-surface glass holder that is constructed in accordance with the principles of the present invention has a flexible base that contains a mass. The mass includes any type of a material that can adapt to the shape of the base and which has sufficient weight. The mass may include any preferred granular mass, such as sand or it may include any preferred type of a liquid. The base may include a plurality of compartments, each compartment containing a portion of the mass. An elastomeric member that includes an opening near the center is attached to the top of the mass. The elastomeric member is adapted to flex into an open position that is able to receive the bottom portion of a glass vessel in the opening. The elastomeric member is then urged into a closed position wherein the opening bears upon and makes contact with the bottom portion of the vessel, thereby securing the vessel to the top of the mass. According to a modification, a modified elastomeric member is included that is not attached to a modified mass. The modified elastomeric member includes a modified opening and is adapted for removal apart from the modified mass, as desired. The modified elastomeric member is adapted to surround the modified mass at which time the modified opening is able to bear against a vessel placed on top of the modified mass, thereby securing the vessel to the top of the modified mass.

DETAILED DESCRIPTION OF THE INVENTION

Figure 1:
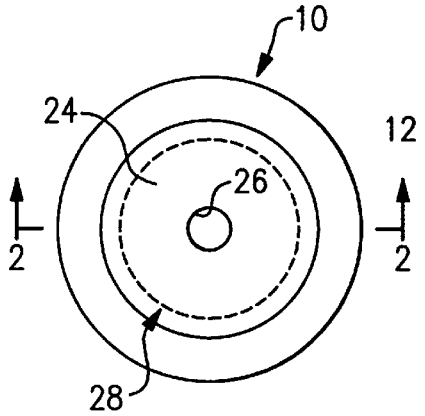
FIG. 1 is a plan view of the top of an irregular-surface glass holder.
Figure 2:
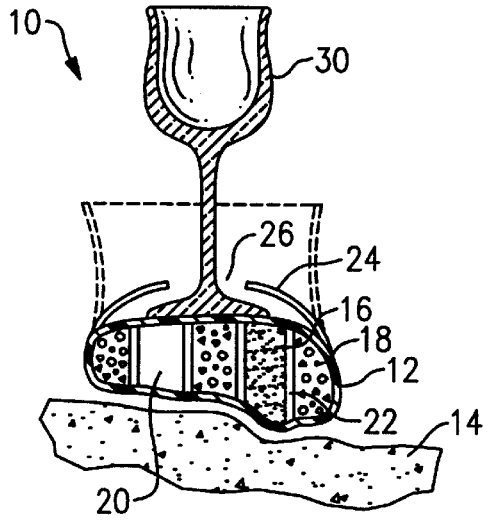
FIG. 2 is a cross sectional view taken on the line 2—2 in FIG. 1 with a stemware glass added and supported by the irregular-surface glass holder that is now placed on a rock.
Figure 3:
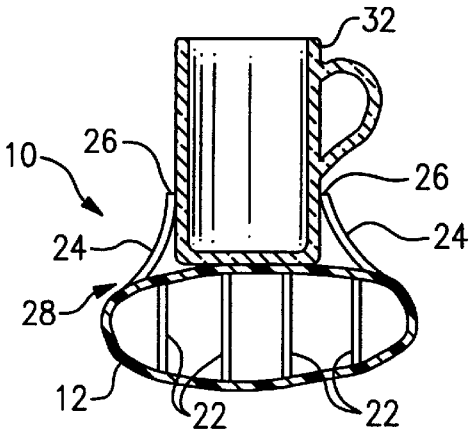
FIG. 3 is a cross sectional view taken on the line 2—2 in FIG. 1 with a coffee cup type of a vessel added and supported by the irregular-surface glass holder.

Referring to the FIGS. 1, 2, and 3 drawings is shown, an irregular-surface glass holder, identified in general by the reference numeral 10.

A base 12 is provided that is flexible and able to adjust and adapt to the contour of an irregular surface. The irregular surface, as shown in FIG. 2, includes a portion of a rock 14 that is sloped and irregular, although the irregular-surface glass holder is equally adaptable for use on flat surfaces or on other types of irregular surfaces.

The base 12 contains any preferred type of a mass such as sand 16, granules 18, or a liquid 20 that is flexible enough to adapt to the irregular shape taken by the base 12 as the base 12 conforms to the irregular shape of the rock 14 or other type of object that it is placed on.

The mass may be enclosed in a single compartment (see FIG. 4) or in a plurality of smaller compartments (See FIGS. 2 and 3) that include dividers 22 inside of the base 12 which separate the base 12 into the smaller compartments.

The dividers 22 limit the amount that the mass can shift inside of the base 12. If the preferred mass is a type of the liquid 20, the dividers 22 prevent an excess of the liquid 20 from moving down to one side of the base 12 should the base 12 be placed on an inclined surface, such as on a sloping surface of the rock 14, thereby adding stability to the irregular-surface glass holder 10.

An elastomeric member (hereinafter, "the elastomer 24") that is circular in shape and includes an opening 26 in the center is attached to the top of the base 12. The elastomer 24 may be attached by sewing or by glue, both of which are identified in general by the reference numeral 28.

The elastomer 24 may include any preferred type of elastomeric material or fabric material such as neoprene, rubber, including other stretchable types of materials. SPANDEX is a preferred type of a material that is used to form the elastomer 24.

The material that forms the exterior of the base 12 is any preferred flexible material that is able to adapt its shape to at least partially conform to that of the rock 14 (i.e., irregular surface) and is also able to contain the mass. Any type of a fabric material, as desired, may be used to form the base 12, depending upon the mass that is used. Similarly, any material that is used to form the elastomer 24 may also be used to form the exterior of the base 12. As the base 12 is used to contain the mass, it forms a "bag" that surrounds the mass.

The elastomer 24 is adapted to be moved (i.e., it may be urged by hand) into an open position (shown in dashed lines in FIG. 2). It is manually stretched and forced by hand to flex into the open position where it is able to receive the bottom portion of a glass vessel 30.

The vessel 30 shown (FIG. 2) is a piece of stemware although any type of a suitably sized drinking vessel may be used. The bottom of the vessel 30 is placed so that it passes through the opening 26 and rests on top of the base 12.

If desired, the elastomer 24 could be opened even further into a fully opened position (not shown) so that it actually begins to wrap around the base 12 in a direction that is generally toward the rock 14.

If the elastomer 24 is urged into the fully opened position, the top of the base 12 is fully exposed for placing the vessel 30 on it. However, it is necessary to open the elastomer 24 only enough so that the vessel 30 can be placed through the opening 26 and on top of the base 12.

The elastomer 24 is then released so that it naturally contracts into a closed position where that portion of the elastomer 24 that is proximate the opening 26 bears upon and makes contact with the bottom portion of the vessel 30, thereby securing the vessel 30 to the top of the base 12.

Accordingly, the elastomer 24 is able to hold the vessel 30, regardless of its shape, to the base 12. This makes the irregular-surface glass holder 10 especially useful. Referring to FIG. 3, a mug 32, such as is used to hold coffee, is being secured to the base 12 by the irregular-surface glass holder 10.

This illustrates how the irregular-surface glass holder 10 is able to secure any type of a straight-sided container as well as stemware to the base 12, providing only that the opening 26 can be expanded to encircle and therefore to grasp the maximum diameter of the bottom portion of the container (i.e., the mug 32 or vessel 30).

Figure 4:
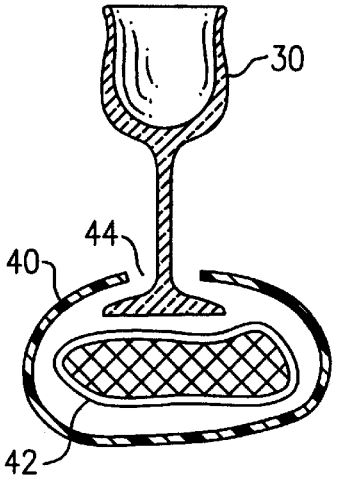
FIG. 4 is a cross sectional view of a modified type of an irregular-surface glass holder.

Referring now also to FIG. 4, a modified elastomeric member 40 is included that is able to surround a modified base 42, but it is not attached to the modified base 42.

The modified elastomeric member 40 includes a modified opening 44 that can be expanded a sufficient amount so that it is adapted for removal apart from the modified base 42, as desired.

When the modified elastomeric member 40 is placed around the modified base 32, it surrounds the modified base 42 and the modified opening 44 is able to bear against the vessel 30 that is placed on top of the modified base 42, thereby securing the vessel 30 to the top of the modified base 42.

The modified elastomeric member 40 is urged off of the modified base 42 to remove the vessel 30 therefrom. To secure the vessel 30 in place, the vessel 30 is first placed on top of the modified base 42 and the modified elastomeric member 40 is then urged over the modified base 42 until the modified opening 44 makes contact with the bottom portion of the vessel 30.

The modified elastomeric member 40 surrounds the modified base 42 in a manner that resembles a sock (not shown) that is placed around a foot (not shown). Elastomeric tension holds the sock in position over the foot.

Similarly, elastomeric tension secures the modified elastomeric member 40 to the modified base 42 while similarly also applying a force to the vessel that urges and secures the vessel 30 to the modified base 42.

The modified elastomeric member 40 can be removed apart from the modified base 42 and, once removed, it can be washed as desired without affecting the modified base 42. This is desirable because a beverage may spill out from the vessel 30 and fall on the modified elastomeric member 40 which will then require periodic cleaning of the modified elastomeric member 40.

The modified base 42 is otherwise similar to the base 12 in that it also contains the desired mass and it may or may not include the compartments, as desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An irregular-surface glass holder that is adapted to secure a glass, comprising:

(a) a flexible base that contains a mass and including at least one vertical divider in said flexible base, said at least one divider separating said mass into at least two portions; and (b) flexible means adapted to cooperate with said base wherein said flexible means is adapted to receive a substantially planar and circular base portion of said glass through an opening provided in said flexible means and to retain said glass in an upright position and said substantially planar and circular base portion of said glass proximate said base and wherein said flexible means includes an elastomer and wherein said flexible means is attached to said base and wherein said elastomer is adapted to contact a portion of said substantially planar and circular base portion of said glass when said elastomer is disposed in a closed position sufficient to retain said substantially planar and circular base portion of said glass proximate said base.

2. The irregular-surface glass holder of claim 1 wherein said flexible base includes a container.

3. The irregular-surface glass holder of claim 2 wherein said container includes a bag.

4. The irregular-surface glass holder of claim 1 wherein said mass includes a solid.

5. The irregular-surface glass holder of claim 4 wherein said solid includes a plurality of solids.

6. The irregular-surface glass holder of claim 5 wherein said plurality of solids includes granules.

7. The irregular-surface glass holder of claim 5 wherein said plurality of solids includes sand.

8. The irregular-surface glass holder of claim 1 wherein said mass includes a liquid.

9. The irregular-surface glass holder of claim 1 wherein said glass includes a drinking vessel.

10. The irregular-surface glass holder of claim 9 wherein said drinking vessel includes a stemware.

11. The irregular-surface glass holder of claim 9 wherein said drinking vessel includes a mug.

12. The irregular-surface glass holder of claim 1 wherein said elastomer includes a SPANDEX.

13. An irregular-surface drinking vessel holder that is adapted to secure a drinking vessel, comprising:

(a) a flexible base, said base adapted to change the shape of said flexible base sufficient to at least partially conform a portion of a bottom of said flexible base to the shape of an object upon which said flexible base is placed;

(b) a material disposed in said base, said material including a sufficient mass that is adapted to conform to the shape of said flexible base and including at least one vertical divider in said base, said at least one divider separating said mass into at least two portions; and (c) elastomeric means adapted to cooperate with said flexible base wherein said flexible base is adapted to receive at least a portion of a substantially planar and circular base portion of said drinking vessel through an opening provided in said elastomeric means and retain said drinking vessel in an upright position and said substantially planar and circular base portion of said drinking vessel proximate said flexible base and wherein said elastomeric means is adapted to contact a portion of said substantially planar and circular base portion of said drinking vessel when said elastomeric means is disposed in a closed position sufficient to retain said substantially planar and circular base portion of said drinking vessel proximate said flexible base.

14. The irregular-surface drinking vessel holder of claim 13 wherein said elastomeric means is attached to said flexible base.

15. The irregular-surface drinking vessel holder of claim 13 wherein said elastomeric means is adapted to surround said flexible base.

16. An irregular-surface glass holder that is adapted to secure a glass, comprising:

(a) a flexible base that contains a mass; and (b) flexible means adapted to cooperate with said base wherein said flexible means is adapted to receive a substantially planar and circular base portion of said glass through an opening provided in said flexible means and to retain said glass in an upright position and said substantially planar and circular base portion of said glass proximate said base and wherein said flexible means includes an elastomer and wherein said flexible means is attached to said base and wherein said substantially planar and circular base portion of said glass includes a bottom portion of a stemware and wherein said elastomer is adapted to contact and to surround a portion of said substantially planar and circular base portion of said stemware when said elastomer is disposed in a closed position sufficient to retain said substantially planar and circular base portion of said stemware proximate said base.

17. An irregular-surface glass holder that is adapted to secure a glass, comprising:

(a) a flexible base that contains a mass and including at least one vertical divider in said flexible base, said at least one divider separating said mass into at least two portions; and (b) flexible means adapted to cooperate with said base wherein said flexible means is adapted to receive said glass through an opening provided in said flexible means and to retain said glass proximate said base and wherein said flexible means includes an elastomer and wherein said flexible means is adapted to surround said base and is not attached to said base and wherein said elastomer is adapted to contact a portion of said glass when said elastomer is disposed in a closed position sufficient to retain said glass proximate said base.

* * * * *